United States Patent [19]

Schroeder

[11] Patent Number: 4,895,365

[45] Date of Patent: Jan. 23, 1990

[54] BASKETBALL GOAL MOUNTING AND BACKBOARD REINFORCING APPARATUS

[75] Inventor: Edward A. Schroeder, Algonquin, Ill.

[73] Assignee: Porter Equipment Company, Chicago, Ill.

[21] Appl. No.: 352,196

[22] Filed: May 16, 1989

[51] Int. Cl.[4] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| 4,245,518 | 8/1981 | Pearo | 273/1.5 R |
| 4,320,896 | 3/1982 | Engle et al. | 273/1.5 R |
| 4,377,283 | 3/1983 | Mahoney | 273/1.5 R |
| 4,395,040 | 7/1983 | White | 273/1.5 R |
| 4,433,839 | 2/1984 | Simonseth | 273/1.5 R |
| 4,588,188 | 5/1986 | Mahoney et al. | 273/1.5 R |
| 4,739,988 | 4/1988 | Schroeder | 273/1.5 R |

*Primary Examiner*—Paul E. Shapiro

[57] ABSTRACT

A basketball goal mounting system for transmitting stresses directly to a backboard frame which includes a vertical support member to resist bowing and canting of the frame unit. The mounting system utilizes spacer elements extending through the basketball goal support, a pair of support elements on each side of the vertical support member and a rear plate for a pair of upper bolts, as well as a pair of low bolts extending through the basketball goal support, the bottom backboard frame member and the rear plate. Provision is also made for mounting the system on a central support independent of the goal mounting.

13 Claims, 2 Drawing Sheets

BASKETBALL GOAL MOUNTING AND BACKBOARD REINFORCING APPARATUS

BACKGROUND AND SUMMARY OF THE INVENTION

The invention is directed to an improved mounting and reinforcing structure for attaching basketball goal to the mounting structure that supports the basketball backboard. With the advent of "slam dunking" of basketballs through the goal, the attendant hanging-on to goal by the basketball shooter, and the vibration and impact loading induced by the use of movable or breakaway type goal systems, additional provisions are necessary to keep glass backboards from breaking. The use of vertical supports extending between upper and lower frames of a basketball backboard support frame with a basketball goal mounted to this vertical support can be found in Mahoney et al, U.S. Pat. No. 4,588,188 of May 13, 1986, and the MEDART Mobile Hydraulic Backstop No. 202 (MEDART brochure B-79-10M-9-78 and brochure MB85-1). Both of the MEDART brochures show the basketball goal only attached to the vertical support. The Mahoney patent shows the basketball goal attached to various of the mounting brackets used for securing the vertical support to the frame. In Mahoney, the vertical support is spaced from the basketball backboard and has a most cumbersome mounting arrangement for the vertical support to the exterior of the backboard support frame. This prevents the mounting of the goal and backboard frame to a center mounting support structure.

Applicant has devised a backboard mounting structure with a vertical support bar extending between the opposed upper and lower internally facing edges of the frame holding the backboard to minimize bowing of the backboard and backboard frame. The vertical support is positioned with a gasketing material to contact and support the glass section providing improved ball rebound qualities of the backboard and at the same time, allow the use of thinner glass sections or clear acrylic materials. This vertical support is attached to the lower edge of the backboard frame through a plate and two hollow structural members to form a rigid bottom attaching mounting between the frame and the vertical support. The basketball goal is attached at its top surface to the frame via stiff connecting elements which pass through clearance holes in the backboard itself and which are secured in holes extending through the plate and the two hollow structural members. At a lower portion of the basketball goal, there is a direct bolting to the lower frame of the basketball backboard mounting frame. This direct mounting is possible since the attachment is to the lower frame, below the lower edge of the glass section basketball backboard itself.

The instant invention provides an improvement over the above referenced prior art in that the stress loads from the basketball goal are applied to the lower portion of the frame itself and not directly to the vertical support member. In addition the vertical support member abuts the glass backboard and thus provides support for deflections in the backboard itself as well as for providing stiffening of the basketball backboard support frame to minimize its deflection.

Additionally, the invention provides for a simple mounting for the vertical support which is accomplished with only three structured members, i.e., two hollow structural members and a flat plate mounted on the lower frame of the backboard mounting support. This structure is then also utilized to hold the stiff connecting members which extend through the glass backboard to secure the basketball goal to the basketball backboard frame.

Also by having a smooth rear mounting plate with tapped mounting holes, the backboard frame assembly is easily aligned on a center mounting support structure independent of the four goal mounting bolts that extend through the backboard front and the rear mounting support plate.

By this arrangement, all forces applied to this goal are transferred directly through the backboard frame and into the rear center support structure (ceiling-suspended or portable-type support structures). Another unique advantage of this mounting system is that the goal may be quickly and easily changed if required during game situations without loosening the backboard mounting hardware or changing the level or plumpness of the backboard frame.

Other objects, advantages and novel features of the present invention will become apparent from the following detailed description of the invention when considered in conjunction with the accompanying drawings.

DETAILED DESCRIPTION OF THE DRAWINGS

Figure 1:
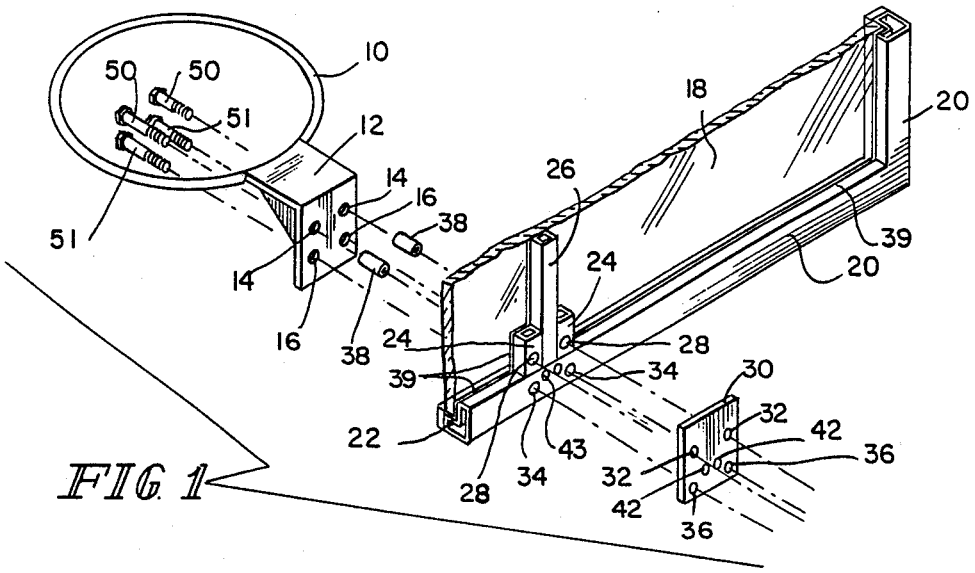
FIG. 1 shows an exploded partial view of the elements making up the basketball goal support system of the invention.
Figure 2:
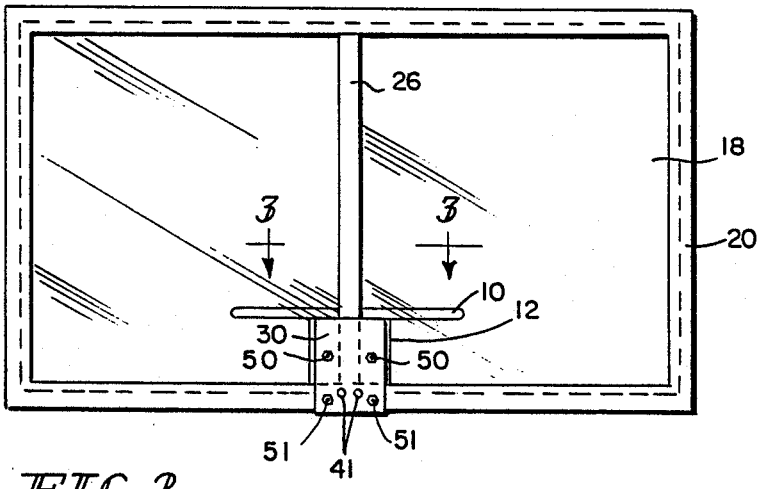
FIG. 2 is a rear view of the basketball backboard support frame showing the mounting structure for the vertical support.

FIG. 1 shows a basketball goal 10 attached as a unit to a L-shaped basketball goal mount 12 into which four holes have been drilled, i.e., two large holes 14 and two smaller holes 16. A glass basketball backboard 18 is supported on a lip 22 of L-shaped basketball backboard frame support 20. Two upwardly opening hollow structural members 24 are welded to the inner surface of the lower portion of the frame support 20 and separated from one another by a distance equal to the thickness of a vertical support member 26. These upward extending hollow structural members 24 have holes 28 therethrough which holes correspond in diameter to the upper holes 14 on the basketball goal mount 12.

A rear plate 30 is provided adjacent the rear side of the basketball backboard unit, in line and flush with the backside of lower basketball backboard frame support 20 and the rear side of the two hollow structural members 24 and the vertical support members 26. This rear plate 30 has two upper holes 32 of a similar size to the upper holes 28 in the hollow structural members 24 and the upper holes 14 in the basketball goal mount 12.

The small holes 16 in the basketball goal mount 12 are in alignment and of equal size with the small holes 34 in the lower backboard frame support 20 and the small holes 36 in the rear plate 30.

In assembling the device, the center vertical support member 26 is located between the facing opposed inner surfaces of the upper and lower backboard frame supports and between the two hollow structural members 24 located adjacent thereto. The two hollow structural members are then welded at their bottom to the lower basketboard frame support 20 and at their facing horizontal top and rear vertical edges to the vertical support member 26. The rear bottom edge of the vertical support member 26 is welded to the lower backboard support frame 20. The upper end of the vertical support member can be welded directly to the upper backboard support frame 20. Since the width of the backboard frame 20 behind the backboard 18 and the width of the vertical support member 26 are equal, the vertical support member does not interfer with a possible center support mounting and resists bowing and canting of the top and bottom sections of the backboard support by the tight fit of the vertical support member 26. The rear plate 30 is then welded along its edges to the rear of basketball backboard lower frame support 20, the two hollow structural members 24 and the vertical support member 26 providing even more support against bowing or canting.

The glass backboard 18 is placed onto a resilient gasket 34 which surrounds the edge of the backboard and extends around to about the rear side of the backboard to cushion the backboard from lip 22 of the backboard frame. Also, a portion of this gasket is located between the backboard and the center vertical support member 26. The glass backboard 18 is mounted on the gasket 38 located on lip 22 of the backboard frame support 20 and is secured thereto in a conventional manner as known in the art such as, for example, by plates 29 spaced around the front of the backboard 20 in the manner shown by U.S. Pat. No. 4,588,188 to Mahoney, issued May 13, 1986. The plates 29 can be secured to the backboard frame support 20 by any of tinning, brazing or by bolts or clips.

Spacer tubes 38 are then inserted through the large holes 14 in the basketball goal support 12, through even larger aligned holes (not shown) in the backboard 18 itself, through large holes 28 in the two hollow structural members 24 and the large holes 32 in the back plate 30. Conventional bolts 50 are inserted through these spacer tubes to hold the basketball goal support fixed to the rear plate. The spacer tubes are of a length equal to the combines thickness of the basketball goal plate 12, the lower basketball goal backboard frame support 20 and the backplate 32 to provide definite alignment of the basketball goal with the lower basketball backboard frame 30. Since the holes (not shown) in the backboard 18 itself are larger than the diameter of the spacer tubes 38, stress caused by jolting on the basketball goal will be passed to the hollow structural members 24 and rear plate 30 and hence to the lower basketball backboard frame support 30 without stressing the backboard 18 itself. This type of spacer collar mounting is known in the art.

Additional bolts 51 are also attached through the lower sets of aligned holes 16, 34 and 36 to additionally secure the basketball goal support 14 directly to the lower basketball backboard frame 20. Since the vertical support member reinforces the positional stability of the lower backboard frame 20, the structure provides an additional rigidity.

Thus it can be seen that a simple and rigid mounting for the basketball goal is Provided and one which will apply basketball goal stresses directly to the basketball backboard frame support 20 and also to a central floor support, if used.

Figure 3:
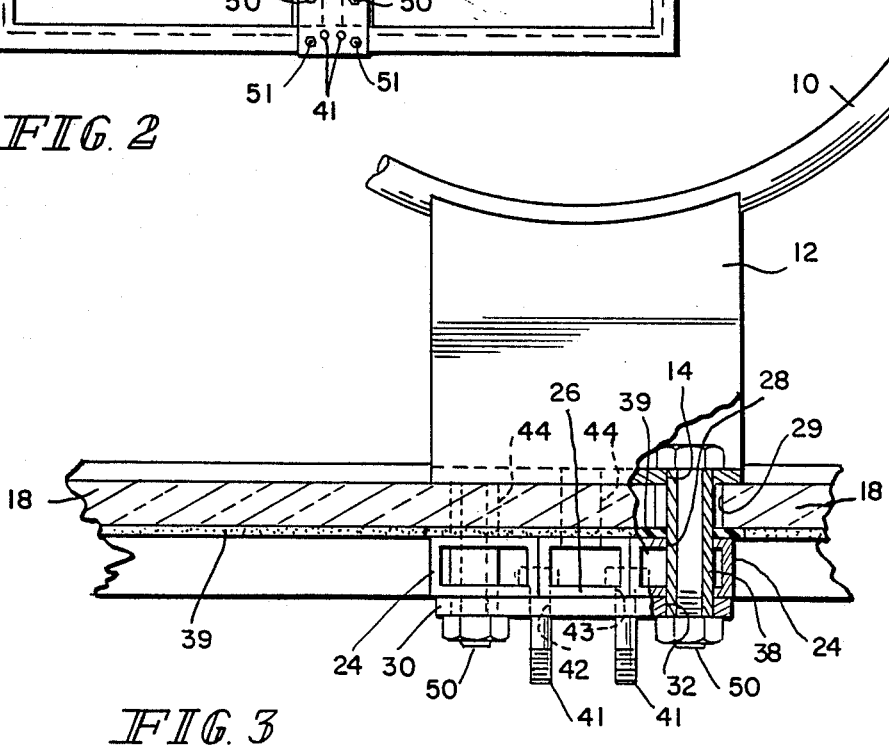
FIG. 3 is a plan view taken along the line 3—3 of FIG. 2.
Figure 4:
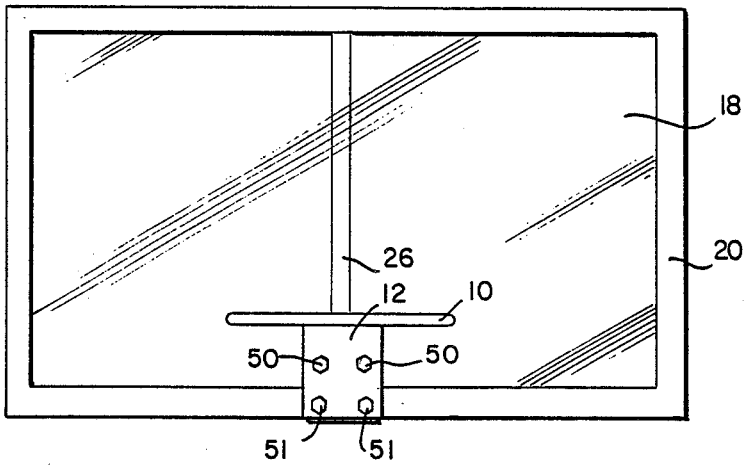
FIG. 4 is a front view of the basketball backboard.
Figure 5:
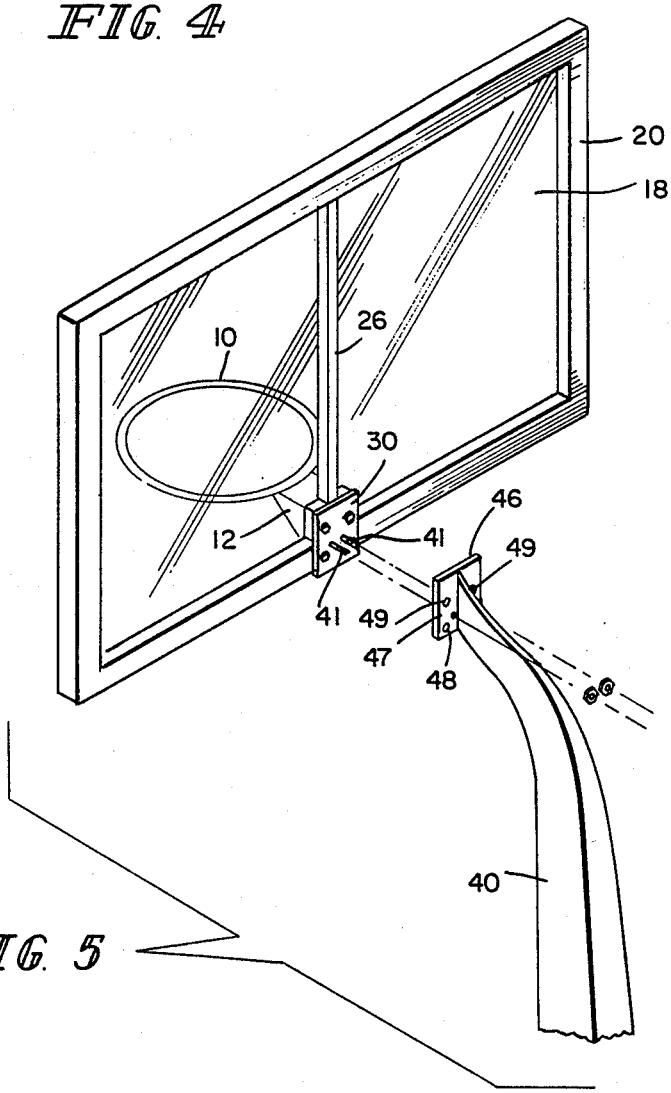
FIG. 5 is a separated view of the basketball backboard with a center floor mount.

For mounting of the backboard to a center floor mount 40, there are provided alignment bolts 41 in holes 42 in the backplate 32 (see FIGS. 3 and 5) which are the same size as holes 43 in the rear side of the hollow bottom frame member 20. Larger holes 44 are located in the front side of the hollow bottom frame member 20. The heads of the bolts 41 can freely pass through the large holes 44 but cannot pass through the small holes 42, 43. The bolts can be tined, welded or screwed into the small holes 42 and/or 43 to hold them in any extended position wherein they cooperate with holes 47 in the face plate 49 of the central mount support 40.

In assembly, these small bolts 41 are placed through the holes 47 and by appropriate movement in the holes 47, which are somewhat larger than the bolt diameters, the backboard assembly can be aligned with the center mount support 40 and the court using a level. After alignment, the goal is placed on the backboard itself, but with different longer length spacer tubes. The spacer tubes should also extend through holes 49 in the face plate 46 of the central mount 40 so that the goal is supported in part by this central mount 40. Likewise, the smaller bolts passing through the holes 34 should extend through holes 48 in the face plate 46. The goal is aligned also with a level. This allows separate alignment of the backboard and the goal. The smooth and flush backplate 30 allows for an easy connection to the center mount.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A basketball goal supporting system for transferring stress applied to a basketball goal to a frame holding a basketball backboard comprising:

a basketball backboard;

a basketball backboard support means for supporting the basketball backboard and having at least upper and lower opposed support frame members;

a basketball backboard vertical support means extending between facing opposed inner surfaces of the upper and lower support frame members and abutting a rear side of the basketball backboard for minimizing bowling and canting of said backboard and backboard support means;

two support means attached to the backboard lower support frame member, one on each side of the vertical support means;

rear plate means attached to the backboard lower support frame member and the two support means for providing rigidity to the basketball backboard;

a first trio of aligned aperture means in the two support means, the backboard and the rear plate means for receiving fastening means for the basketball goal;

a second pair of aligned aperture means in said lower support frame member and said rear plate means for receiving fastening means for the baseball goal; and said fastening means for mounting a basketball goal to said system extending through said first trio and second pair of aperture means to transfer stresses from said basketball goal to said basketball backboard support means directly and through said two support means.

2. The basketball goal supporting system of claim 1, wherein the two support means are hollow structural members.

3. The basketball goal supporting system of claim 2, wherein the connection of the two support means, the vertical support member means and the rear plate means to the lower basketball backboard frame support member is by welding.

4. The basketball goal supporting system of claim 3, wherein the vertical support member mean is secured by welding to the two support means and to the rear plate means.

5. The basketball goal supporting system of claim 2, wherein the vertical support member means is a hollow structural member and is secured to the upper and lower basketball backboard frame support members.

6. The basketball goal supporting system of claim 1, wherein the connection of the two support means, the vertical support member means and the rear plate means to the lower basketball backboard frame support member is by welding.

7. The basketball goal supporting system of claim 6, wherein the vertical support member means is secured by welding to the two support means and to the rear plate means.

8. The basketball goal supporting system of claim 1, wherein the vertical support member means is secured by welding to the two support means and to the rear plate means.

9. The basketball goal supporting system of claim 1, wherein the vertical support member means is secured to the upper and lower basketball backboard frame support members.

10. The basketball goal supporting system of claim 1, wherein the fastening means extending through the first trio of aperture means includes a spacer means having a diameter equal to the diameter of the first aperture means in the support means and the rear plate means and with the third of the trio of aperture means located in the backboard means being of a larger diameter.

11. The basketball goal supporting system of claim 1, wherein a rear portion of the vertical support member and a rear side of the lower frame member coincide to form a flat support surface for the rear plate means.

12. The basketball goal supporting system of claim 1, wherein an additional pair of fastening aperture means are provided in a rear face of the lower support frame member and rear plate means for the reception of additional fasteners to mount the system on a central support independent of a goal.

13. The basketball goal supporting system according to claim 12, wherein there are apertures in a front face of the lower support frame member aligned with the additional aperture means and having a large enough opening area that the fasteners can be inserted therethrough to be extended out the additional apertures in the rear face of the lower support frame member.

* * * * *